US007048362B2

(12) United States Patent
Takahashi

(10) Patent No.: US 7,048,362 B2
(45) Date of Patent: May 23, 2006

(54) APPARATUS FOR EJECTING DROPLETS AND METHOD FOR MANUFACTURING THE SAME

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 25 days.

(21) Appl. No.: 10/706,447

(22) Filed: Nov. 12, 2003

(65) Prior Publication Data

US 2004/0095439 A1 May 20, 2004

(30) Foreign Application Priority Data

Nov. 15, 2002 (JP) ..... 2002-331745

(51) Int. Cl.
*B41J 2/045* (2006.01)

(52) U.S. Cl. ..... 347/72; 347/68

(58) Field of Classification Search ..... 347/54–73; 310/328

See application file for complete search history.

(56) References Cited

U.S. PATENT DOCUMENTS 3,317,762 A * 5/1967 Corwin et al. ..... 310/334
6,142,616 A * 11/2000 Akahane ..... 347/71
2002/0080213 A1* 6/2002 Shimada et al. ..... 347/68

FOREIGN PATENT DOCUMENTS

JP 2002234171 8/2002

OTHER PUBLICATIONS

Marks' Standard Handbook for Mechanical Engineers, 10th ed. New York, McGraw-Hill, 1996. pp. 6-11. TJ151.S82 1996.*

* cited by examiner

*Primary Examiner*—Stephen Meier
*Assistant Examiner*—Geoffrey Mruk
(74) *Attorney, Agent, or Firm*—Reed Smith LLP

(57) ABSTRACT

An ink-jet head is constructed by a passage unit and an actuator unit being put in layers. The passage unit and the actuator unit are independently formed, and then bonded to each other by being heated with a thermosetting adhesive being interposed therebetween to not less than a curing temperature of the thermosetting adhesive. At an operating temperature after the thermosetting adhesive has cured by heat so as to bond the passage unit and the actuator unit to each other, the actuator unit receives stress of −40 MPa to 10 MPa in a direction parallel to a face thereof bonded to the passage unit. Accordingly, both of capacitance between electrodes included in the actuator unit and a drive voltage required for driving the actuator unit are optimized.

7 Claims, 11 Drawing Sheets

FIG. 6

| Stress(MPa) | Capacitance(nF) | Voltage(V) |
|---|---|---|
| −50 | 0. 97 | 38 |
| −40 | 1 | 28 |
| −20 | 1. 05 | 24 |
| 0 | 1. 13 | 23 |
| 10 | 1. 2 | 22. 3 |
| 20 | 1. 32 | 22 |
| 40 | 1. 6 | 21. 5 |

FIG. 8

| DIFFERENCE IN LINEAR EXPANSION COEFFICIENT (ppm/°C) | HEATING TEMPERATURE (°C) | | | | | | | | | | | | | | | | | |
|---|---|---|---|---|---|---|---|---|---|---|---|---|---|---|---|---|---|---|
| | 30°C | 40°C | 50°C | 60°C | 70°C | 80°C | 90°C | 100°C | 110°C | 120°C | 130°C | 140°C | 150°C | 160°C | 170°C | 180°C | 190°C | 200°C |
| -10.0 | 16.3 | 21.7 | 27.1 | 32.5 | 37.9 | 43.3 | 48.3 | 54.2 | 59.6 | 65.0 | 70.4 | 75.8 | 81.3 | 86.7 | 92.1 | 97.5 | 102.9 | 108.3 |
| -9.0 | 14.6 | 19.5 | 24.4 | 29.3 | 34.1 | 39.0 | 43.9 | 48.8 | 53.6 | 58.5 | 63.4 | 68.3 | 73.1 | 78.0 | 82.9 | 87.8 | 92.6 | 97.5 |
| -8.0 | 13.0 | 17.3 | 21.7 | 26.0 | 30.3 | 34.7 | 39.0 | 43.3 | 47.7 | 52.0 | 56.3 | 60.7 | 65.0 | 69.3 | 73.7 | 78.0 | 82.3 | 86.7 |
| -7.0 | 11.4 | 15.2 | 19.0 | 22.8 | 26.5 | 30.3 | 34.1 | 37.9 | 41.7 | 45.5 | 49.3 | 53.1 | 56.9 | 60.7 | 64.5 | 68.3 | 72.0 | 75.8 |
| -6.0 | 9.8 | 13.0 | 16.3 | 19.5 | 22.8 | 26.0 | 29.3 | 32.5 | 35.8 | 39.0 | 42.3 | 45.5 | 48.8 | 52.0 | 55.3 | 58.5 | 61.8 | 65.0 |
| -5.0 | 8.1 | 10.8 | 13.5 | 16.3 | 19.0 | 21.7 | 24.4 | 27.1 | 29.8 | 32.5 | 35.2 | 37.9 | 40.6 | 43.3 | 46.0 | 48.8 | 51.5 | 54.2 |
| -4.0 | 6.5 | 8.7 | 10.8 | 13.0 | 15.2 | 17.3 | 19.5 | 21.7 | 23.8 | 26.0 | 28.2 | 30.3 | 32.5 | 34.7 | 36.8 | 39.0 | 41.2 | 43.3 |
| -3.0 | 4.9 | 6.5 | 8.1 | 9.8 | 11.4 | 13.0 | 14.6 | 16.3 | 17.9 | 19.5 | 21.1 | 22.8 | 24.4 | 26.0 | 27.6 | 29.3 | 30.9 | 32.5 |
| -2.0 | 3.3 | 4.3 | 5.4 | 6.5 | 7.6 | 8.7 | 9.8 | 10.8 | 11.9 | 13.0 | 14.1 | 15.2 | 16.3 | 17.3 | 18.4 | 19.5 | 20.6 | 21.7 |
| -1.0 | 1.6 | 2.2 | 2.7 | 3.3 | 3.8 | 4.3 | 4.9 | 5.4 | 6.0 | 6.5 | 7.0 | 7.6 | 8.1 | 8.7 | 9.2 | 9.8 | 10.3 | 10.8 |
| 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 |
| 1.0 | -1.6 | -2.2 | -2.7 | -3.3 | -3.8 | -4.3 | -4.9 | -5.4 | -6.0 | -6.5 | -7.0 | -7.6 | -8.1 | -8.7 | -9.2 | -9.8 | -10.3 | -10.8 |
| 2.0 | -3.3 | -4.3 | -5.4 | -6.5 | -7.6 | -8.7 | -9.8 | -10.8 | -11.9 | -13.0 | -14.1 | -15.2 | -16.3 | -17.3 | -18.4 | -19.5 | -20.6 | -21.7 |
| 3.0 | -4.9 | -6.5 | -8.1 | -9.8 | -11.4 | -13.0 | -14.6 | -16.3 | -17.9 | -19.5 | -21.1 | -22.8 | -24.4 | -26.0 | -27.6 | -29.3 | -30.9 | -32.5 |
| 4.0 | -6.5 | -8.7 | -10.8 | -13.0 | -15.2 | -17.3 | -19.5 | -21.7 | -23.8 | -26.0 | -28.2 | -30.3 | -32.5 | -34.7 | -36.8 | -39.0 | -41.2 | -43.3 |
| 5.0 | -8.1 | -10.8 | -13.5 | -16.3 | -19.0 | -21.7 | -24.4 | -27.1 | -29.8 | -32.5 | -35.2 | -37.9 | -40.6 | -43.3 | -46.0 | -48.8 | -51.5 | -54.2 |
| 6.0 | -9.8 | -13.0 | -16.3 | -19.5 | -22.8 | -26.0 | -29.3 | -32.5 | -35.8 | -39.0 | -42.3 | -45.5 | -48.8 | -52.0 | -55.3 | -58.5 | -61.8 | -65.0 |
| 7.0 | -11.4 | -15.2 | -19.0 | -22.8 | -26.5 | -30.3 | -34.1 | -37.9 | -41.7 | -45.5 | -49.3 | -53.1 | -56.9 | -60.7 | -64.5 | -68.3 | -72.0 | -75.8 |
| 8.0 | -13.0 | -17.3 | -21.7 | -26.0 | -30.3 | -34.7 | -39.0 | -43.3 | -47.7 | -52.0 | -56.3 | -60.7 | -65.0 | -69.3 | -73.7 | -78.0 | -82.3 | -86.7 |
| 9.0 | -14.6 | -19.5 | -24.4 | -29.3 | -34.1 | -39.0 | -43.9 | -48.8 | -53.6 | -58.5 | -63.4 | -68.3 | -73.1 | -78.0 | -82.9 | -87.8 | -92.6 | -97.5 |
| 10.0 | -16.3 | -21.7 | -27.1 | -32.5 | -37.9 | -43.3 | -48.8 | -54.2 | -59.6 | -65.0 | -70.4 | -75.8 | -81.3 | -86.7 | -92.1 | -97.5 | -102.9 | -108.3 |
| 11.0 | -17.9 | -23.8 | -29.8 | -35.8 | -41.7 | -47.7 | -53.6 | -59.6 | -65.5 | -71.5 | -77.5 | -83.4 | -89.4 | -95.3 | -101.3 | -107.3 | -113.2 | -119.2 |
| 12.0 | -19.5 | -26.0 | -32.5 | -39.0 | -45.5 | -52.0 | -58.5 | -65.0 | -71.5 | -78.0 | -84.5 | -91.0 | -97.5 | -104.0 | -110.5 | -117.0 | -123.5 | -130.0 |
| 13.0 | -21.1 | -28.2 | -35.2 | -42.3 | -49.3 | -56.3 | -63.4 | -70.4 | -77.5 | -84.5 | -91.5 | -98.6 | -105.6 | -112.7 | -119.7 | -126.8 | -133.8 | -140.8 |
| 14.0 | -22.8 | -30.3 | -37.9 | -45.5 | -53.1 | -60.7 | -68.3 | -75.8 | -83.4 | -91.0 | -98.6 | -106.2 | -113.8 | -121.3 | -128.9 | -136.5 | -144.1 | -151.7 |
| 15.0 | -24.4 | -32.5 | -40.6 | -48.8 | -56.9 | -65.0 | -73.1 | -81.3 | -89.4 | -97.5 | -105.6 | -113.8 | -121.9 | -130.0 | -138.1 | -146.3 | -154.4 | -162.5 |
| 16.0 | -26.0 | -34.7 | -43.3 | -52.0 | -60.7 | -69.3 | -78.0 | -86.7 | -95.3 | -104.0 | -112.7 | -121.3 | -130.0 | -138.7 | -147.3 | -156.0 | -164.7 | -173.3 |
| 17.0 | -27.6 | -36.8 | -46.0 | -55.3 | -64.5 | -73.7 | -82.9 | -92.1 | -101.3 | -110.5 | -119.7 | -128.9 | -138.1 | -147.3 | -156.5 | -165.8 | -175.0 | -184.2 |
| 18.0 | -29.3 | -39.0 | -48.8 | -58.5 | -68.3 | -78.0 | -87.8 | -97.5 | -107.3 | -117.0 | -126.8 | -136.5 | -146.3 | -156.0 | -165.8 | -175.5 | -185.3 | -195.0 |
| 19.0 | -30.9 | -41.2 | -51.5 | -61.8 | -72.0 | -82.3 | -92.6 | -102.9 | -113.2 | -123.5 | -133.8 | -144.1 | -154.4 | -164.7 | -175.0 | -185.3 | -195.5 | -205.8 |
| 20.0 | -32.5 | -43.3 | -54.2 | -65.0 | -75.8 | -86.7 | -97.5 | -108.3 | -119.2 | -130.0 | -140.8 | -151.7 | -162.5 | -173.3 | -184.2 | -195.0 | -205.8 | -216.7 |
| 21.0 | -34.1 | -45.5 | -56.9 | -68.3 | -79.6 | -91.0 | -102.4 | -113.8 | -125.1 | -136.5 | -147.9 | -159.3 | -170.6 | -182.0 | -193.4 | -204.8 | -216.1 | -227.5 |
| 22.0 | -35.8 | -47.7 | -59.6 | -71.5 | -83.4 | -95.3 | -107.3 | -119.2 | -131.1 | -143.0 | -154.9 | -166.8 | -178.8 | -190.7 | -202.6 | -214.5 | -226.4 | -238.3 |
| 23.0 | -37.4 | -49.8 | -62.3 | -74.8 | -87.2 | -99.7 | -112.1 | -124.6 | -137.0 | -149.5 | -162.0 | -174.4 | -186.9 | -199.3 | -211.8 | -224.3 | -236.7 | -249.2 |
| 24.0 | -39.0 | -52.0 | -65.0 | -78.0 | -91.0 | -104.0 | -117.0 | -130.0 | -143.0 | -156.0 | -169.0 | -182.0 | -195.0 | -208.0 | -221.0 | -234.0 | -247.0 | -260.0 |
| 25.0 | -40.6 | -54.2 | -67.7 | -81.3 | -94.8 | -108.3 | -121.9 | -135.4 | -149.0 | -162.5 | -176.0 | -189.6 | -203.1 | -216.7 | -230.2 | -243.8 | -257.3 | -270.8 |
| 26.0 | -42.3 | -56.3 | -70.4 | -84.5 | -98.6 | -112.7 | -126.8 | -140.8 | -154.9 | -169.0 | -183.1 | -197.2 | -211.3 | -225.3 | -239.4 | -23.5 | -267.6 | -281.7 |

FIG. 9

| x: DIFFERENCE IN LINEAR EXPANSION COEFFICIENT (ppm/°C) | MAXIMUM HEATING TEMPERATURE (°C) |
|---|---|
| 18<x≦24 | 30 |
| 14<x≦18 | 40 |
| 12<x≦14 | 50 |
| 10<x≦12 | 60 |
| 9<x≦10 | 70 |
| 8<x≦9 | 80 |
| 7<x≦8 | 90 |
| 6<x≦7 | 100 |
| 5<x≦6 | 120 |
| 4<x≦5 | 140 |
| 3<x≦4 | 180 |
| −1<x≦3 | 200 |
| −2<x≦−1 | 180 |
| −3<x≦−2 | 90 |
| −4<x≦−3 | 60 |
| −5<x≦−4 | 40 |
| −7<x≦−5 | 30 |

FIG. 10

| | | LINEAR EXPANSION COEFFICIENT (ppm/°C) | DIFFERENCE IN LINEAR EXPANSION COEFFICIENT (ppm/°C) | HEATING TEMPERATURE (ppm/°C) |
|---|---|---|---|---|
| ACTUATOR UNIT | PZT | 5 | — | — |
| PASSAGE UNIT | SUS430 | 10. 4 | 5. 4 | 120 or less |
| | SUS304 | 17. 3 | 12. 3 | 50 or less |
| | 42 ALLOY | 4. 5 | −0. 5 | 200 or less |

APPARATUS FOR EJECTING DROPLETS AND METHOD FOR MANUFACTURING THE SAME

BACKGROUND OF THE INVENTION

1. Field of the Invention

The present invention relates to an apparatus capable of ejecting droplets, and a method for manufacturing the apparatus.

2. Description of Related Art

One type of ink-jet head in an ink-jet printer is formed by a passage unit and an actuator unit being put in layers. The passage unit includes therein ink passages each constituted by an ink tank, a pressure chamber, and a nozzle, etc. The actuator unit applies pressure to ink contained in the pressure chamber in the passage unit. As the passage unit, for example, a layered structure of plural metal plates made of 42% nickel alloy steel (42 alloy) may be adopted. As the actuator unit, for example, a layered structure of plural piezoelectric ceramic sheets in which individual electrodes and common electrodes always kept at the ground potential are alternately sandwiched between the piezoelectric sheets may be adopted. An electric field is in advance applied to regions sandwiched between the individual electrodes and the common electrodes in the actuator unit, to thereby produce active portions polarized in their thickness direction.

The passage unit and the actuator unit are bonded to each other with an adhesive or an adhesive sheet being interposed therebetween such that the above-mentioned active portions may face the pressure chambers in the passage unit. When a drive pulse signal is applied to the individual electrodes, portions of the actuator unit corresponding to the active portions deform to change the volume of the pressure chambers. Thereby, pressure is applied to ink that has been supplied from the ink tank into the pressure chambers, and then the ink is ejected from the nozzles.

When capacitance between the electrodes at the active portion of the actuator unit is large or when a high drive voltage is required for driving the actuator unit, a power consumption (which is proportional to a product of the capacitance and a square of the drive voltage) of a driver circuit for driving the actuator unit uneconomically becomes large. In such a case, heat generation in the driver circuit significantly increases, and hence troubles by heating may easily be caused. In order to prevent the troubles by heating, a relatively expensive driver must be used to disadvantageously raise the cost of an electric system. Moreover, a heat sink, which is attached to dissipate heat generated in the driver circuit, need be large in size, and accordingly a size of an apparatus as a whole is also increased. Further, when capacitance between the electrodes at the active portion of the actuator unit is large, a delay corresponding to a charge time of a capacitor arises to thereby exhibit a moderate change in voltage between the electrodes. Consequently, it becomes hard to drive the actuator unit in a desired manner.

Capacitance between electrodes at an active portion of an actuator unit can be reduced by decreasing areas of the electrodes, which however increases a drive voltage required for providing a desired deformation of the active portion. That is, capacitance and a drive voltage have a correlation that the larger one becomes, the smaller the other becomes. Accordingly, it is hard to optimize both of them at the same time in order to avoid the aforementioned problems.

SUMMARY OF THE INVENTION

An object of the present invention is to provide an apparatus for ejecting droplets capable of optimizing both capacitance between electrodes included in an active portion of an actuator unit and a drive voltage required for driving the actuator unit, and to provide a method for manufacturing the apparatus.

A continued study to achieve the foregoing object by the present inventor has revealed that a proper setting of a value of stress applied to an actuator unit may decrease both capacitance between electrodes included in an active portion of the actuator unit and a drive voltage required for driving the actuator unit, at the same time.

According to a first aspect of the present invention, there is provided an apparatus for ejecting droplets comprising: a passage unit formed therein with plural nozzles through which droplets are ejected and pressure chambers each connected to a corresponding nozzle; and an actuator unit that applies an ejection energy to liquid in the pressure chambers, in which a piezoelectric sheet is sandwiched between electrodes to thereby form plural active portions, the actuator unit being bonded to the passage unit such that each of the active portions may face the pressure chambers, wherein, at an operating temperature, the actuator unit receives stress of −40 MPa to 10 MPa in a direction substantially parallel to a face thereof bonded to the passage unit.

When the actuator unit receives the stress within the aforementioned range, both of capacitance between the electrodes included in the active portions of the actuator unit and a drive voltage required for driving the actuator unit become relatively small and thereby optimized According to a second aspect of the present invention, there is provided a method for manufacturing an apparatus for ejecting droplets, comprising the steps of: forming a passage unit formed therein with plural nozzles through which droplets are ejected and pressure chambers each connected to a corresponding nozzle; forming an actuator unit that applies an ejection energy to liquid in the pressure chambers, in which a piezoelectric sheet is sandwiched between electrodes to thereby form plural active portions; overlapping the actuator unit and the passage unit with each other with a thermosetting adhesive having a predetermined curing temperature and being interposed therebetween such that each of the active portions may face the pressure chambers; heating the passage unit and the actuator unit overlapped with each other with the thermosetting adhesive being interposed therebetween up to the predetermined curing temperature of the thermosetting adhesive; and leaving the passage unit and the actuator unit until cooling down to the operating temperature after the thermosetting adhesive has cured such that the actuator unit may receive stress of −40 MPa to 10 MPa in a direction substantially parallel to a face thereof bonded to the passage unit.

In the above-described second aspect, the stress applied to the actuator unit can be set at the aforementioned predetermined value by bonding the passage unit and the actuator unit using a thermosetting adhesive that cures at an appropriate curing temperature. Thus, the apparatus for ejecting droplets according to the above first aspect can easily be manufactured. In addition, the above method can provide a wide variance in selection of materials constituting the passage unit and the actuator unit.

It is here to be noted that the "operating temperature" in the first and second aspects means an ordinary ambient temperature at which the apparatus for ejecting droplets is to be used, e.g., at which an ink-jet head conducts printing on a paper, etc.

BRIEF DESCRIPTION OF THE DRAWINGS

Other and further objects, features and advantages of the invention will appear more fully from the following description taken in connection with the accompanying drawings in which:

FIG. 6 is a table showing results of experiments in which stress to be applied to the actuator unit was varied and capacitance and a drive voltage in each case were measured;

FIG. 8 is a table showing results of experiments in which a difference in linear expansion coefficient between the passage unit and the actuator unit and a heating temperature in a heating step were combined in various values, and stress applied to the actuator unit in an ordinary temperature after the heating step was measured with respect to each combination;

FIG. 9 is a table showing a relation of a difference in linear expansion coefficient between the passage unit and the actuator unit versus a maximum temperature in the heating step obtained with respect to the difference in linear expansion coefficient, on condition that stress applied to the actuator unit has predetermined values; and FIG. 10 is a table showing results of examinations based on the table of FIG. 9, in which a material constituting the passage unit was changed and a heating temperature with respect to each material was measured.

DESCRIPTION OF THE PREFERRED EMBODIMENTS

Figure 1:
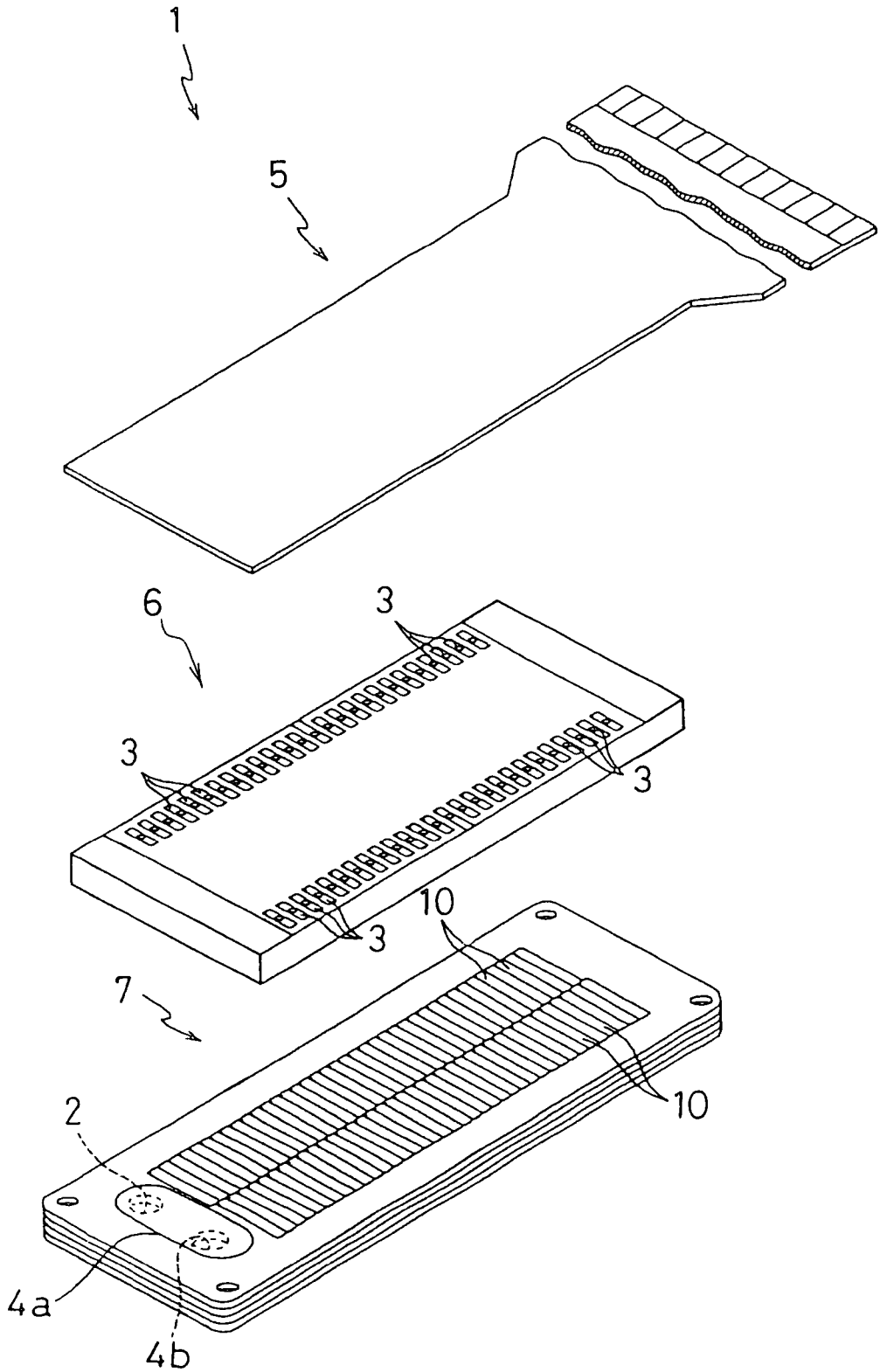
FIG. 1 is an exploded perspective view of an ink-jet head (apparatus for ejecting droplets) according to a first aspect of the present invention.

As illustrated in FIG. 1, a piezoelectric ink-jet head (apparatus for ejecting droplets.) 1 according to an embodiment of the present invention has a structure in which a passage unit 7 with a nearly rectangular parallelepiped shape is laminated thereon with an actuator unit 6 having almost the same shape as the passage unit 7, and a flexible flat cable or a flexible printed circuit (FPC) 5 for connecting the actuator unit 6 with an external circuit is attached onto the actuator unit 6. The ink-jet head 1 ejects ink droplets downward from nozzles 9 (see FIGS. 2 and 3) that open at a lower face of the passage unit 7.

Lots of surface electrodes 3 used for electrical connection with the FPC 5 are formed on an upper face of the actuator unit 6. Lots of pressure chambers 10 opening upward are formed on an upper face of the passage unit 7. A pair of supply holes 4*a* and 4*b* each communicating with a later-described manifold channel (liquid containing chamber) 15 (see FIG. 3) are provided in a vicinity of one longitudinal end of the passage unit 7. The supply holes 4*a* and 4*b* are covered with a filter 2 for removing dust in ink supplied from an ink cartridge (not illustrated).

Figure 2:
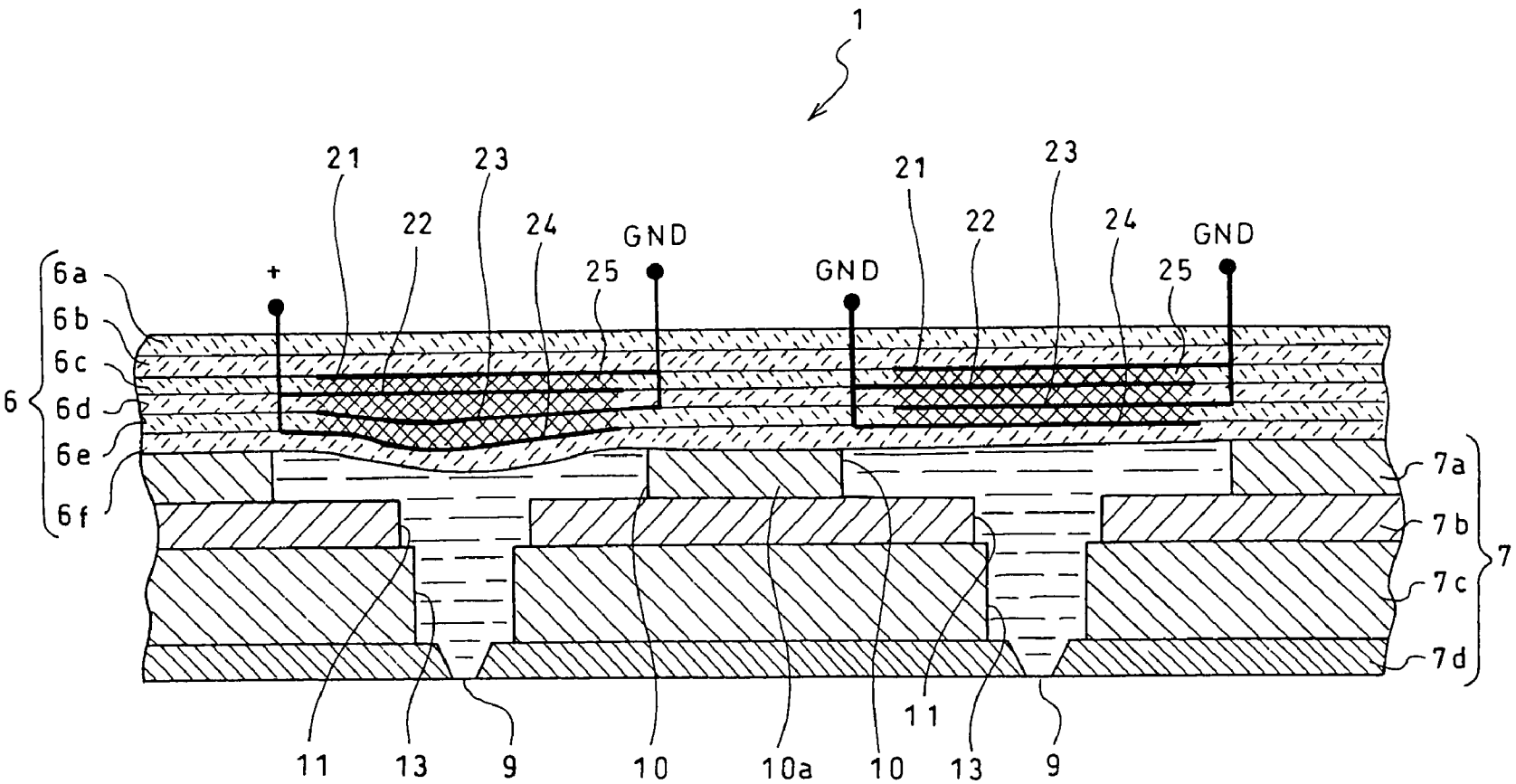
FIG. 2 is a partial sectional view of the ink-jet head of FIG. 1 taken along a longitudinal direction thereof.
Figure 3:
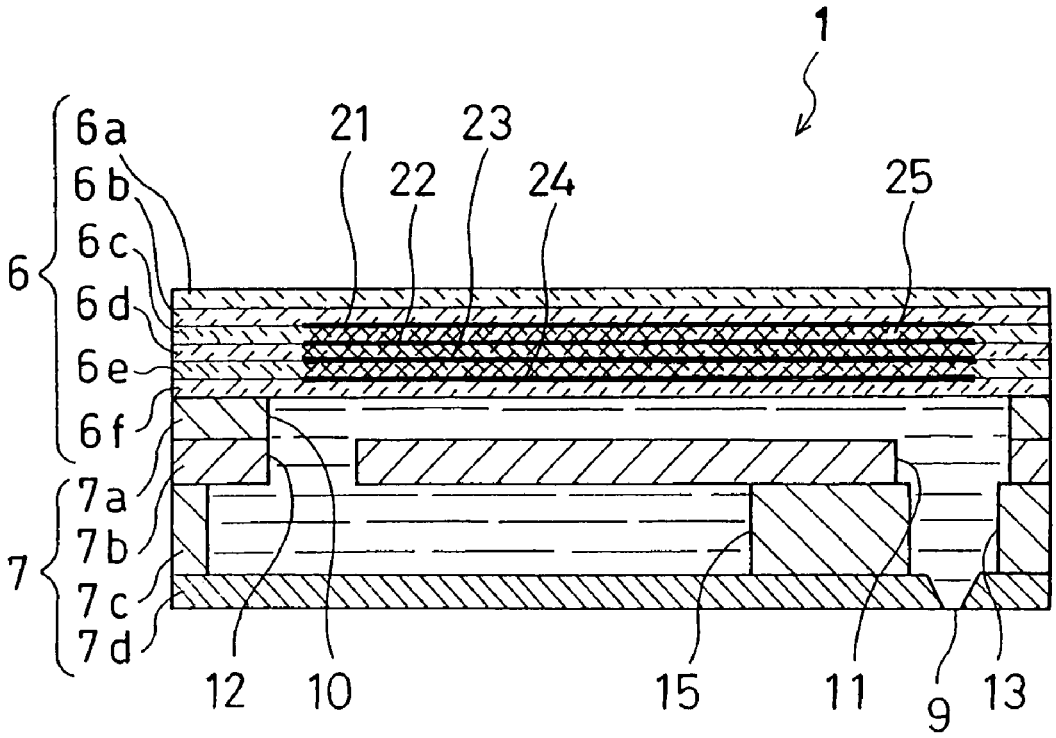
FIG. 3 is a partial sectional view of the ink-jet head of FIG. 1 taken along a widthwise direction thereof.

Next, a detailed structure of the ink-jet head 1 will be described with further reference to FIGS. 2 and 3. FIG. 2 is a partial sectional view of the ink-jet head of FIG. 1 taken along a longitudinal direction thereof. FIG. 3 is a partial-sectional view of the ink-jet head of FIG. 1 taken along a widthwise direction thereof. An illustration of the FPC 5 on the actuator unit 6 is omitted in FIGS. 2 and 3.

The passage unit 7 is formed by laminating three thin plates (a cavity plate 7*a* as a first plate, a spacer plate 7*b*, and a manifold plate 7*c* as a second plate) made of a metallic material such as 42% nickel alloy steel (hereinafter referred to as "42 alloy") and a nozzle plate 7*d* as a third plate made of a synthetic resin such as polyimide with the nozzles 9 for ejecting ink droplets. The uppermost cavity plate 7*a* is in contact with the actuator unit 6.

On a surface of the cavity plate 7*a*, pressure chambers 10 that receive therein ink to be selectively ejected in accordance with an operation of the actuator unit 6 are formed in two lines along a length of the cavity plate 7*a*. The pressure chambers 10 are separated from each other by partitions 10*a*, and arranged with longitudinal directions thereof being parallel to each other. The manifold plate 7*c* is formed with the manifold channel 15 for supplying ink to the pressure chambers 10. The manifold channel 15 is formed below a line of the pressure chambers 10 so as to extend longitudinally along the line. One end of the manifold channel 15 is connected to a non-illustrated ink supply source through either one of the pair of supply holes 4*a* and 4*b* illustrated in FIG. 1.

One end of the pressure chamber 10 communicates with the manifold channel 15 through a communication hole 12 in the spacer plate 7*b*, and the other end thereof communicates with the nozzle 9 through the communication holes 11 and 13 in the spacer plate 7*b* and the manifold plate 7*c*, respectively. In this manner, formed is an ink passage extending from the manifold channel 15, through the communication hole 12, the pressure chamber 10, the communication hole 11, and the communication hole 13, to the nozzle 9.

The actuator unit 6 is formed by laminating six piezoelectric ceramic plates 6*a* to 6*f* made of a ceramic material such as lead zirconate titanate (PZT). Common electrodes 21 and 23 are disposed between the piezoelectric ceramic plates 6*b* and 6*c* and between the piezoelectric ceramic plates 6*d* and 6*e*, respectively. Each of the common electrodes 21 and 23 is formed only in an area above the corresponding pressure chamber 10 of the passage unit 7. The common electrodes 21 and 23 may be disposed over a wide range covering substantially the whole area of the respective piezoelectric ceramic plates. On the other hand, individual electrodes 22 and 24 are disposed between the piezoelectric ceramic plates 6*c* and 6*d* and between the piezoelectric ceramic plates 6*e* and 6*f*, respectively. Each of the individual electrodes 22 and 24 is formed only in an area above the corresponding pressure chamber 10 of the passage unit 7. The common electrodes 21 and 23 and the individual electrodes 22 and 24 are connected to the corresponding surface electrodes 3 formed on the upper face of the actuator unit 6.

The common electrodes 21 and 23 are always kept at the ground potential. On the other hand, a drive pulse signal is applied to the individual electrodes 22 and 24. Regions of the piezoelectric ceramic plates 6*c* to 6*e* sandwiched between the common electrodes 21, 23 and the individual electrodes 22, 24 are made into active portions 25 polarized in their thickness direction by being applied with an electric field in advance by these electrodes. Each of the active portion 25 has, in a plan view, a rectangular shape extending in the same direction as that of the pressure chamber 10 so as to fall within the pressure chamber 10. Like this, the actuator unit 6 is formed therein with the plural active portions 25 that is deformable in a direction substantially perpendicular to a plane of the piezoelectric ceramic plates 6*a* to 6*f* (i.e., in a thickness direction of the piezoelectric ceramic plates 6*a* to 6*f*).

When the individual electrodes 22 and 24 are set at a predetermined positive potential, the active portions 25 of the piezoelectric ceramic plates 6*c* to 6*e* are applied with an electric field and therefore going to expand in their thickness direction. The piezoelectric ceramic plates 6*a* and 6*b*, however, do not exhibit such a phenomenon. Accordingly, a portion of the actuator unit 6 corresponding to each active portion 25, as a whole, swells up to expand toward a pressure chamber 10 side. A volume of the pressure chamber 10 is thereby reduced, and ejection pressure is applied to ink in the pressure chamber 10 to eject ink droplets from the nozzle 9.

A left one of two pressure chambers 10 in FIG. 2 illustrates a state where a volume of a pressure chamber 10 is reduced by the actuator unit 6 that is expanding toward the pressure chamber 10 side by an application of a predetermined positive potential, as described above. At this time, an ink droplet is ejected from a nozzle 9 communicating with this pressure chamber 10. A right one in FIG. 2 illustrates a state where a nozzle 9 communicating with a pressure chamber 10 ejects no ink droplets because the drive pulse signal is kept at the ground potential that is identical to the potential of the common electrodes 21 and 23.

An ink droplet may be ejected using a method of so-called fill-before-fire, in which, an electric field is applied in a normal condition to the individual electrodes 22 and 24 corresponding to all the pressure chambers 10 so as to reduce the volume of all the pressure chambers 10 as exemplified by the left one in FIG. 2, then only the individual electrodes 22 and 24 corresponding to the pressure chambers 10 to be used for ink ejection are relieved of the electric field to increase the volume of the pressure chambers 10 as exemplified by the right one in FIG. 2, and then an electric field is again applied to those individual electrodes 22 and 24 to thereby apply pressure to ink in the pressure chambers 10.

Figure 4:
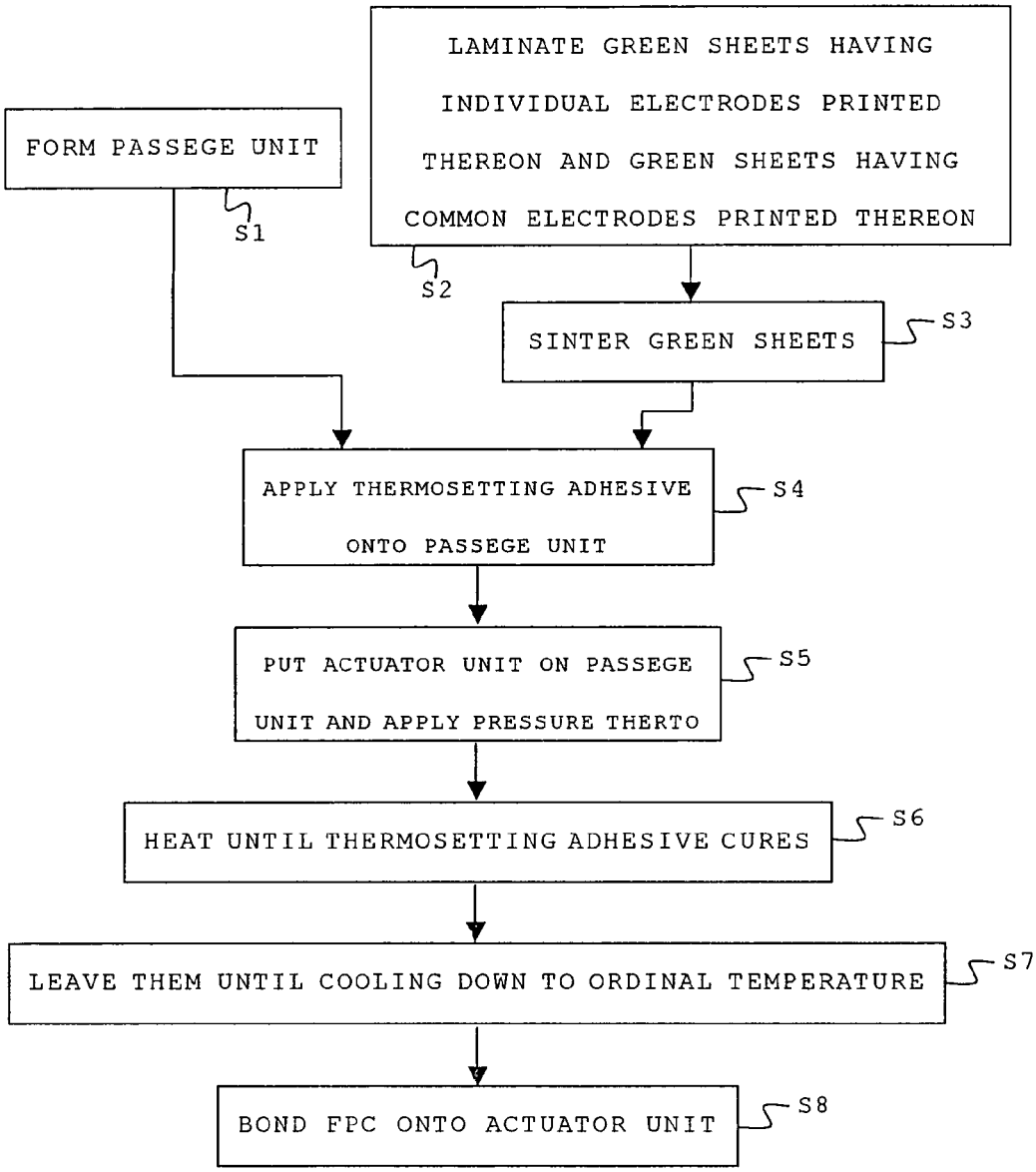
FIG. 4 is a flow chart indicating a method for manufacturing the ink-jet head of FIG. 1.

Next, a method for manufacturing the ink-jet head 1 of this embodiment will be described with reference to FIG. 4. In order to manufacture the ink-jet head 1, the passage unit 7 and the actuator unit 6 are separately formed and then bonded to each other.

In order to form the passage unit 7, the four plates 7*a* to 7*d* illustrated in FIG. 2 are prepared independently of each other, then positioned in layers, and then bonded to each other using a thermosetting adhesive (step S1). An etching method is adopted for forming the pressure chambers 10 and the communication holes 11, etc., in the plates 7*a* to 7*c*, and a laser beam machining is adopted for forming the nozzles 9 in the plate 7*d*.

In order to form the actuator unit 6, first, two green sheets made of piezoelectric ceramic having the individual electrodes 22 and 24, respectively, screen-printed thereon with a conductive paste and two green sheets made of piezoelectric ceramic having the common electrodes 21 and 23, respectively, screen-printed thereon with a conductive paste are alternately put in layers, and further, on the resulted layered structure, a green sheet made of piezoelectric ceramic without any printing thereon and a green sheet made of piezoelectric ceramic having the surface electrodes 3 screen-printed thereon with a conductive paste are put in layers in this order (step S2). Thereby, an electrode assembly to serve as the actuator unit 6 is obtained.

The electrode assembly obtained in the step S2 is degreased similarly to known ceramics, and sintered at a predetermined temperature (step S3). In this way, the actuator unit 6 as described above can relatively easily be manufactured. A design of the actuator unit 6 includes in advance an estimated amount of contraction to be caused by sintering.

Subsequently, the passage unit 7 and the actuator unit 6 formed separately as described above are bonded to each other with a thermosetting adhesive. FIGS. 5A to 5E chronologically illustrate steps for bonding the passage unit 7 and the actuator unit 6. The horizontal direction in FIGS. 5A to 5E represents a longitudinal direction of the passage unit 7 and the actuator unit 6 illustrated in FIGS. 5A to 5E.

Figure 5A:
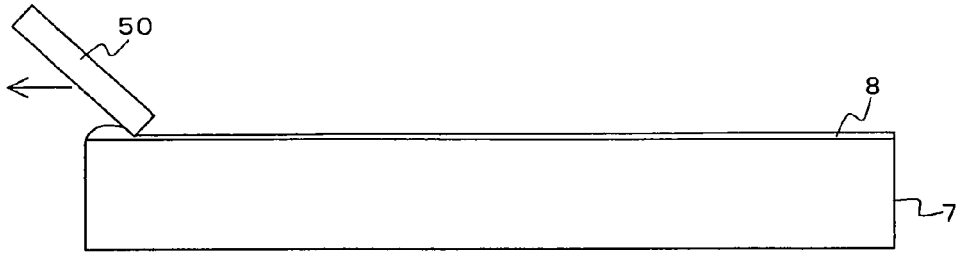
FIGS. 5A to 5E are side views chronologically illustrating steps for bonding a passage unit and an actuator unit.
Figure 5B:
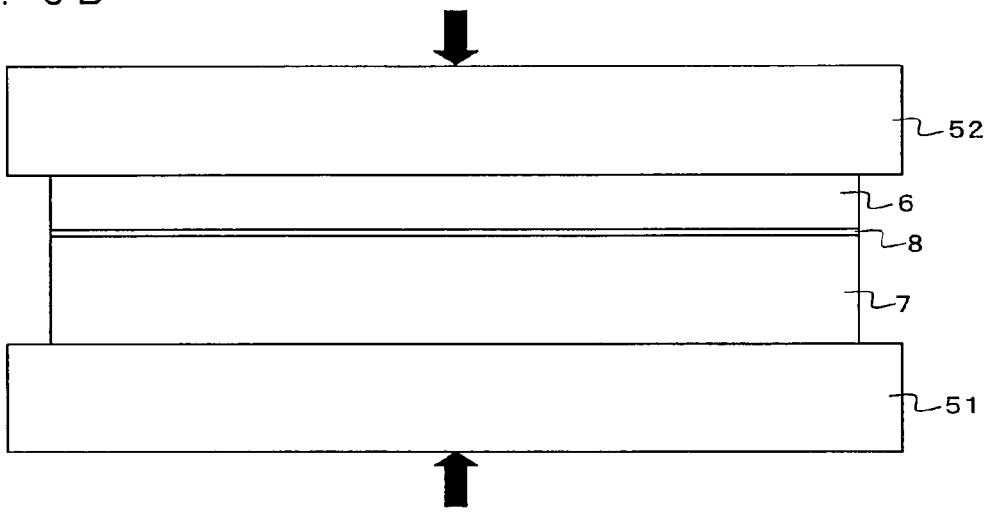

First, as illustrated in FIG. 5A, a thermosetting adhesive 8 is applied to a face of the passage unit 7 with the pressure chambers 10 being formed thereon (a face to be bonded to the actuator unit 6) using a bar coater 50 such that the thermosetting adhesive 8 may have an almost uniform thickness (step S4). Then, as illustrated in FIG. 5B, the actuator unit 6 is disposed on the passage unit 7 with the thermosetting adhesive 8 being interposed therebetween, and both of them are pressurized in a direction indicated by arrows using a jig 51 below the passage unit 7 and a jig 52 above the actuator unit 6 (step S5). Here, the actuator unit 6 and the passage unit 7 are put in layers with the active portions 25 (see FIGS. 2 and 3) and the pressure chambers 10 facing each other.

Figure 5C:
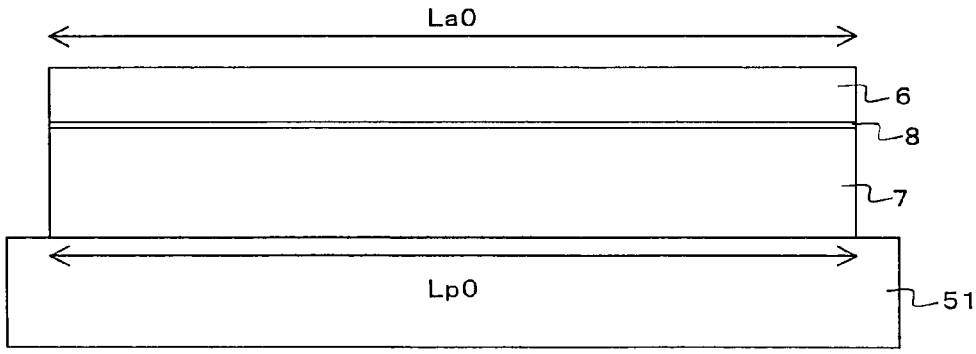

After pressurizing the both with appropriate pressure, as illustrated in FIG. 5C, the jig 52 above the actuator unit 6 is removed. At this time, longitudinal lengths of the passage unit 7 and the actuator unit 6 are defined as Lp0 and La0, respectively.

Then, the jig 51 is heated to thereby heat the actuator unit 6 and the passage unit 7 to a curing temperature of the thermosetting adhesive 8 (step S6). In this heating step, the thermosetting adhesive 8 rises in temperature as well as the actuator unit 6 and the passage unit 7. After they reach the curing temperature of the thermosetting adhesive 8, they are maintained in this state for a predetermined time period until the thermosetting adhesive 8 cures.

Figure 5D:
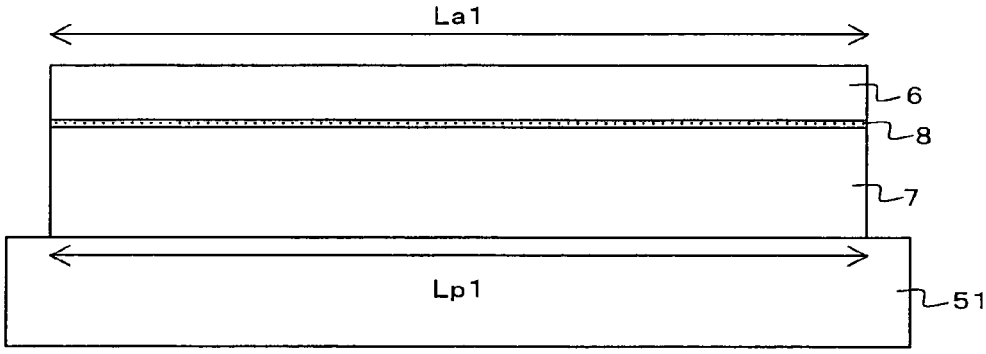

FIG. 5D illustrates a state where the heating step (step S6) has completed and the thermosetting adhesive 8 has cured. At this time, longitudinal lengths Lp1 and La1 of the passage unit 7 and the actuator unit 6 are longer than the lengths Lp0 and La0, respectively, before the heating step as shown in FIG. 5C. This is because, as a temperature rises, the actuator unit 6 and the passage unit 7 expand in accordance with their own linear expansion coefficients.

After the heating step (step S6), they are left until both the passage unit 7 and the actuator unit 6 cool down to an ordinary temperature (operating temperature) (step S7). The thermosetting adhesive 8 is maintained in a cured state even when it cools down to the ordinary temperature after curing in the heating step (step S6). Thus, at the operating temperature of the ink-jet head 1, a state where the passage unit 7 and the actuator unit 6 are bonded to each other with the thermosetting adhesive 8 is maintained.

Figure 5E:
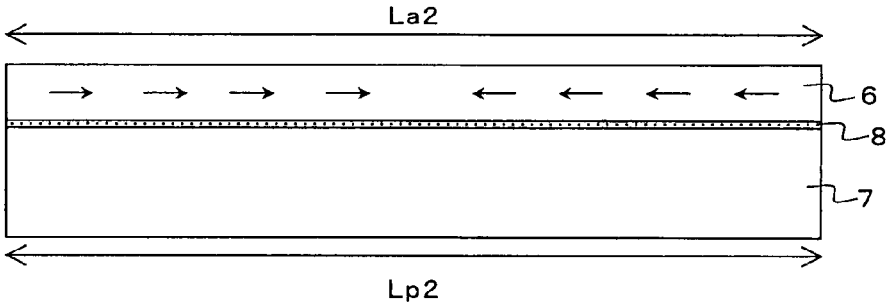

FIG. 5E illustrates a state where both the passage unit 7 and the actuator unit 6 cool down to the ordinary temperature after subjected to the heating step. During a process of cooling down to the ordinary temperature, although both the passage unit 7 and the actuator unit 6 are going to contract in accordance with their own linear expansion coefficients, they contract by almost the same length because the cured thermosetting adhesive 8 binds them to each other. That is, given that longitudinal lengths of the passage unit 7 and the actuator unit 6 are Lp2 and La2, respectively, the expression of "Lp1−Lp2≈La1−La2" is satisfied.

In this embodiment, the linear expansion coefficient of the passage unit 7 is larger than that of the actuator unit 6. Thus, the passage unit 7 expands by heating more largely than the actuator unit 6 does, and the lengths of each of the members 6 and 7 before and after the heating step satisfies the expression of "Lp1−Lp0>La1−La0"Like this, although each of the members 6 and 7 expands in accordance with its own linear expansion coefficient in the heating step (step S6), the cured thermosetting adhesive 8 binds them to each other in the process of cooling down to the ordinary temperature after the heating step as described above, so that each member fails to contract in accordance with its own linear expansion coefficient. In this embodiment, even though the passage unit 7 is going to largely contract, the actuator unit 6 does not contract so largely as the passage unit 7 does. Consequently, the actuator unit 6 receives stress traveling inwardly in the longitudinal direction thereof, i.e., compressive stress (see FIG. 5E).

On the other hand, a reverse of the above description is applicable to a case where the linear expansion coefficient of the passage unit 7 is smaller than that of the actuator unit 6 (the lengths of each of the members 6 and 7 before and after the heating step satisfies the expression of "Lp1−Lp0<La1−La0"). That is, in the process of cooling down to the ordinary temperature after the heating step, even though the actuator unit 6 is going to largely contract, the passage unit 7 does not contract so largely as the actuator unit 6 does. Consequently, the actuator unit 6 receives stress traveling outwardly in the longitudinal direction thereof, i.e., tensile stress (see FIG. 5E).

After the passage unit 7 and the actuator unit 6 are bonded to each other in the steps S4 to S7, the FPC 5 (see FIG. 1) is adhered to the actuator unit 6 by soldering such that the surface electrodes 3 and the corresponding electrodes on the FPC 5 may overlap with each other (step S8).

The ink-jet head 1 is thereby manufactured through the above-described steps.

The thermosetting adhesive 8 is determined such that the actuator unit 6 having cooled down to the ordinary temperature after the heating step may receive a predetermined amount of stress in a substantially parallel direction to the face thereof bonded to the passage unit 7, on the basis of a difference in linear expansion coefficient between the passage unit 7 and the actuator unit 6, in more detail, between a linear expansion coefficient of a material forming the plates 7*a* to 7*c* except the nozzle plate 7*d* and a linear expansion coefficient of a material forming the piezoelectric ceramic plates 6*a* to 6*f*. This embodiment adopts an epoxy-based material as the thermosetting adhesive 8. Since a curing temperature of an epoxy material is 120 degrees C., the actuator unit 6 and the passage unit 7, together with the thermosetting adhesive 8, are heated to 120 degrees C. or more in the heating step.

Particularly in this embodiment, since the longitudinal length of the actuator unit 6 is much longer than a widthwise length thereof, an amount of expansion and contraction becomes larger in its longitudinal direction (the longitudinal direction of the ink-jet head 1 as represented by the horizontal direction in FIGS. 5A to 5E). In this case, the substantially parallel direction to the face bonded to the passage unit 7 in which stress is applied to the actuator unit 6 is, in more detail, a direction along the longitudinal direction of the actuator unit 6.

In a following description, outward and inward directions with respect to the longitudinal of the actuator unit 6 are defined as positive and negative directions, respectively, of the stress applied to the actuator unit 6. Accordingly, when the stress is positive the actuator unit 6 receives tensile stress, and when the stress is negative the actuator unit receives compressive stress.

The "predetermined amount" of stress applied to the actuator unit 6 means −40 MPa to 10 Mpa, as will be described later in detail.

Next, a description will be given, with reference to FIGS. 6, 7A, and 7B, to experiments in which examined was a relation of stress applied to the actuator unit 6 in the ordinary temperature after the heating step versus capacitance between the electrodes included in the active portion of the actuator unit 6 and versus a drive voltage required for providing a predetermined deformation of the active portion.

FIG. 6 is a table showing results of experiments in which stress to be applied to the actuator unit 6 was varied into seven values and capacitance and a drive voltage in each of the seven cases were measured. FIGS. 7A and 7B are graphs of the results shown in FIG. 6. FIG. 7A is a graph showing a relation between the stress applied to the actuator unit 6 and the capacitance. FIG. 7B is a graph showing a relation between the stress applied to the actuator unit 6 and the drive voltage.

Figure 7A:
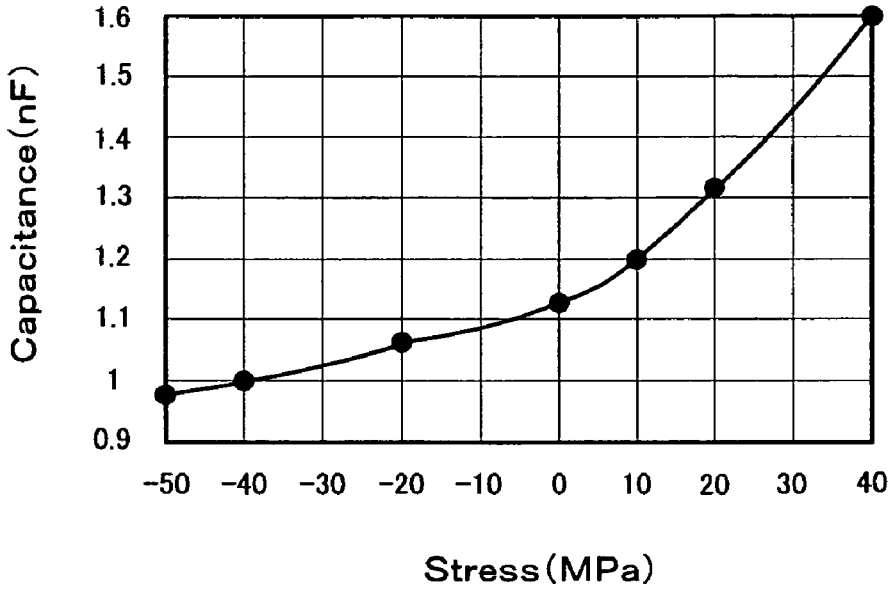
FIGS. 7A and 7B are graphs of the results shown in FIG. 6.

FIG. 7A shows that, as the stress applied to the actuator unit 6 becomes larger, the capacitance also becomes larger. In addition, when the stress applied to the actuator unit 6 is −50 MPa to 10 MPa, a ratio of the increase in capacitance to the increase in stress is relatively small. When the stress applied to the actuator unit 6 exceeds 10 MPa, on the contrary, the ratio of the increase in capacitance to the increase in stress becomes significantly large.

Figure 7B:
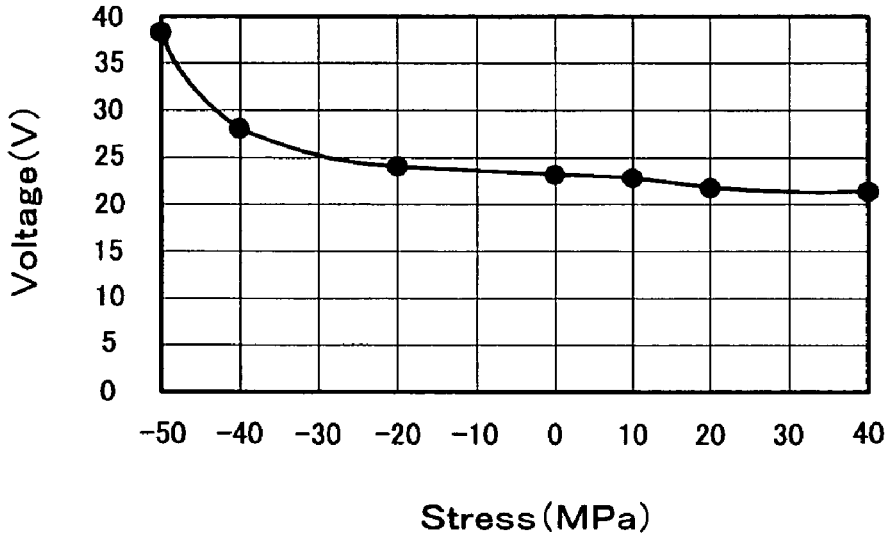

FIG. 7B shows that, as the stress applied to the actuator unit 6 becomes larger, the drive voltage becomes smaller. In addition, when the stress applied to the actuator unit 6 is −50 MPa to −40 MPa, a ratio of the decrease in drive voltage to the increase in stress is significantly large. When the stress applied to the actuator unit 6 exceeds −40 MPa, on the contrary, the ratio of the decrease in drive voltage to the increase in stress becomes relatively small.

In consideration of FIGS. 7A and 7B, it can be seen that, when the stress applied to the actuator unit 6 is −40 MPa to 10 MPa, both the ratio of the increase in capacitance to the increase in stress and the ratio of the decrease in drive voltage to the increase in stress become relatively small. That is, in order to optimize the capacitance and the drive voltage at the same time, the ink-jet head 1 is to be manufactured such that the stress applied to the actuator unit 6 may have the predetermined value as described above.

The stress applied to the actuator unit 6 varies depending on the linear expansion coefficient of the passage unit 7, the linear expansion coefficient of the actuator unit 6, and a heating temperature in the heating step (step S6).

FIG. 8 is a table showing results of experiments in which a difference in linear expansion coefficient between the passage unit 7 and the actuator unit 6 (hereinafter simply referred to as "difference in linear expansion coefficient") and a heating temperature in the heating step were combined in various values, and stress applied to the actuator unit 6, in the ordinary temperature after the heating step, was measured with respect to each combination. Differences in liner expansion coefficient arranged in a leftmost column in FIG.

8 are obtained by subtracting a linear expansion coefficient of the actuator unit 6 from a linear expansion coefficient of the passage unit 7. Heating temperatures are arranged in a top row in FIG. 8. Values shown in this table were obtained by simulations.

The simulations were conducted on the assumption that the actuator unit 6 is formed by 30 μm-thick piezoelectric ceramic plates being put in six layers to have a total thickness of 180 μm and each active portions included therein has a length (active length) of 1.8 mm, and that the passage unit 7 has a thickness (total thickness except the nozzle plate 7*d*) of 500 μm. In addition, assumed was that the ink-jet head 1 is used at the ordinary temperature of 25 degrees C.

FIG. 8 shows which range of the heating temperature enables the stress applied to the actuator unit 6 to be −40 MPa to 10 MPa (i.e., a section enclosed with a thick line) with respect to each value of the difference in linear expansion coefficient. FIG. 9 summarizes a relation of a difference in linear expansion coefficient between the respective members 6 and 7 versus a maximum temperature (maximum heating temperature) in the heating step obtained with respect to the difference in linear expansion coefficient, on condition that the stress applied to the actuator unit 6 has the aforementioned predetermined values. A table in FIG. 9 demonstrates that the maximum heating temperature reaches its highest value when an absolute value of the difference in linear expansion coefficient between the respective members 6 and 7 is around zero, and that the maximum heating temperature becomes lower as the absolute value of the difference in linear expansion coefficient between the respective members 6 and 7 increases.

Here, there will be discussed, on the basis of the above-described results, a desired heating temperature in the heating step, i.e., a thermosetting adhesive having a desired curing temperature in order to cause the stress of −40 MPa to 10 MPa to be applied to the actuator unit 6, when a material of metal plates constituting the passage unit 7 is changed whereas the actuator unit 6 is formed of plural piezoelectric sheets made of a ceramic material such as lead zirconate titanate (PZT).

FIG. 10 is a table showing results of examinations based on the table of FIG. 9, in which a material constituting the passage unit 7 was changed and a heating temperature with respect to each material was measured. Here, stainless steels SUS 430 (JIS) and SUS 304 (JIS), and 42 alloy were adopted as a material of the passage unit 7. The table shows linear expansion coefficients of the above materials, differences in linear expansion coefficient between PZT and the respective materials, and heating temperatures, when these materials are adopted as the material constituting the passage unit 7. This table provides a supposition that, when the actuator unit 6 is made of PZT and the passage unit 7 is made of SUS 430, the members 6 and 7 may be bonded to each other with a thermosetting adhesive 8 having a curing temperature of 120 degrees C. or less so that the actuator unit 6 receives stress of −40 MPa to 10 MPa in the ordinary temperature.

As described above, according to the ink-jet head 1 of this embodiment, stress applied to the actuator unit 6 can be set at −40 MPa to 10 MPa by bonding the passage unit 7 and the actuator unit 6 with a thermosetting adhesive 8 that cures at an appropriate temperature. The foregoing experimental results show that, in a case where the actuator unit 6 receives such an amount of stress, both of capacitance between the electrodes included in the active portions of the actuator unit 6 and a drive voltage required for driving the actuator unit 6 become relatively small at the same time and thereby optimized. Thus, power consumed in a driver circuit for driving the actuator unit 6 may economically be suppressed.

In addition, since heart generation in the driver circuit is suppressed and troubles by heating are hardly caused, a relatively cheap driver circuit may be used so as to lower the cost of an electric system. Moreover, a large-sized heat sink need not be used, and therefore the apparatus may be prevented from increasing in size. A large-sized apparatus hinders a movement of a carriage when used as a serial-type printer, which however can be prevented as well.

Further, when capacitance between the electrodes at the active portions of the actuator unit 6 is large, a delay corresponding to a charge time of a capacitor arises to thereby exhibit a moderate change in voltage between the electrodes. Consequently, it becomes hard to drive the actuator unit 6 in a desired manner. However, this problem can also be relieved.

Still further, the manufacturing method of this embodiment can provide a wide variance in selection of materials constituting the passage unit 7 and the actuator unit 6. This is because a type of the thermosetting adhesive 8 may properly be determined while setting a heating temperature in the heating step (step S6) such that the actuator unit 6 may receive a predetermined amount of stress in the ordinary temperature after the heating step, on the basis of properties of the passage unit 7 and the actuator unit 6.

Still further, the predetermined amount of stress can more surely be applied to the actuator unit 6 by determining the thermosetting adhesive 8 having a predetermined curing temperature on the basis of a difference in linear expansion coefficient between the passage unit 7 and the actuator unit 6.

Still further, for example, even if there is any irregularity in the heating temperature or in the temperature distribution during manufacturing in the heating step, as long as the actuator is formed to receive stress of −40 MPa to 10 Mpa, both capacitance between the electrodes included in the active portions of the actuator unit 6 and a drive voltage required for driving the actuator unit 6 is optimized, and therefore the actuator unit 6 can stably operate.

In the above embodiment, particularly in the reference to FIG. 10, the description is given to the case where PZT is adopted as a material of the actuator unit 6, and any one of stainless steels SUS 430 (JIS) and SUS 304 (JIS), and 42 alloy is adopted as a material of the passage unit 7. However, materials of the actuator unit 6 and the passage unit 7 are not limited to them. For example, the combination of the materials can arbitrarily be changed by setting a heating temperature such that the actuator unit 6 may receive stress of −40 MPa to 10 MPa.

In addition, a heating temperature in the heating step (step S6) may be equal to or more than a curing temperature of the thermosetting adhesive 8.

The present invention is applicable to ink-jet type printer, facsimile, copying machine, and the like. Moreover, droplets of a conductive paste may be ejected to print a very fine electric circuit pattern. Further, droplets of an organic luminescent material may be ejected to make a high-resolution display device such as an organic electroluminescence display (OELD). Otherwise, the apparatus for ejecting droplets of the present invention may be used very widely in applications for forming fine dots on a print medium.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An apparatus for ejecting droplets comprising:

a passage unit formed therein with plural nozzles through which droplets are ejected and pressure chambers each connected to a corresponding nozzle; and an actuator unit that applies an ejection energy to liquid in the pressure chambers, in which a piezoelectric sheet that is disposed over a plurality of pressure chambers is sandwiched between electrodes to thereby form plural active portions, the actuator unit being bonded to the passage unit such that each of the active portions may face the pressure chambers, wherein, at an operating temperature, the actuator unit receives stress of −40 MPa to 10 MPa in a direction substantially parallel to a face thereof bonded to the passage unit.

2. The apparatus according to claim 1, wherein the bonded face of the actuator unit to the passage unit has a rectangular shape, and wherein the stress acts in a direction along a longitudinal direction of the actuator unit.

3. The apparatus according to claim 1, wherein the passage unit has a first plate formed therein with the pressure chambers, a second plate formed therein with a liquid containing chamber that contains liquid provided to the pressure chambers, and a third plate formed therein with the nozzles, and wherein the actuator unit is bonded on the first plate.

4. The apparatus according to claim 3, in the passage unit, wherein the second plate is sandwiched between the first plate and the third plate, and wherein each of the pressure chambers communicates with a corresponding nozzle at one end thereof and with the liquid containing chamber at the other end thereof.

5. The apparatus according to claim 1, wherein a difference in linear expansion coefficient between the passage unit and the actuator unit is more than −7 parts per million (ppm) and below 24 parts per million(ppm).

6. The apparatus according to claim 5, wherein the passage unit and the actuator unit are bonded to each other with a thermosetting adhesive that has a curing temperature of 30° C. to 200° C.

7. The apparatus according to claim 6, wherein the thermosetting adhesive is an epoxy-based material.

* * * * *